United States Patent [19]

Koboshi et al.

[11] Patent Number: 4,770,979

[45] Date of Patent: Sep. 13, 1988

[54] DEVELOPER COMPOSITION

[75] Inventors: Shigeharu Koboshi, Sagamihara; Toshifumi Iijima, Kokubunji; Hiroshi Yamazaki, Kawasaki, all of Japan

[73] Assignee: Konishiroku Photo Industry Co., Ltd., Japan

[21] Appl. No.: 874,791

[22] Filed: Jun. 13, 1986

Related U.S. Application Data

[63] Continuation of Ser. No. 712,904, Mar. 18, 1985, abandoned, which is a continuation of Ser. No. 452,441, Dec. 23, 1982, abandoned.

[30] Foreign Application Priority Data

Dec. 24, 1981 [JP] Japan ..... 56-215505

[51] Int. Cl.[4] ..... G03C 1/72; G03C 5/24

[52] U.S. Cl. ..... 430/479; 206/219; 206/538; 428/402.2; 428/402.21; 428/402.22; 428/402.24; 430/138; 430/446; 430/466

[58] Field of Search ..... 430/138, 466, 446, 479; 206/219, 538; 428/402.2, 402.21, 402.22, 402.26

[56] References Cited

U.S. PATENT DOCUMENTS

| | | | |
|---|---|---|---|
| 3,386,824 | 6/1968 | Miller | 430/449 |
| 3,615,496 | 10/1971 | Hilton et al. | 430/449 |
| 3,645,911 | 2/1972 | van Besauw et al. | 430/138 |
| 3,714,065 | 1/1973 | Kitajima et al. | 430/138 |
| 3,785,824 | 1/1974 | Fisch | 430/466 |

*Primary Examiner*—Mukund J. Shah

*Attorney, Agent, or Firm*—Finnegan, Henderson, Farabow, Garrett & Dunner

[57] ABSTRACT

The present invention provides a photographic developer composition comprising a plurality of developer components, including an alkali agent, that are packed in two or more separate receptacles. At least one of the developer components, except the alkali agent, is encapsulated in an alkali soluble polymer, and is held in at least one receptacle that does not substantially contain the alkali agent.

7 Claims, No Drawings

DEVELOPER COMPOSITION

This application is a continuation of application Ser. No. 712,904 filed Mar. 18, 1985, now abandoned, which in turn is a continutation of Ser. No. 452,441 filed Dec. 23, 1982, now abandoned.

This invention relates to a photographic developer composition and more particularly to a photographic developer composition which has been improved in storage stability of the developer contained therein.

A variety of developer solutions are used in practicing the development of photographic films as well as photographic printing paper. Generally, for easier preparation for actual application of such developer solutions, the developer contained therein is desirably thickened to a thick solution which is then packed, as it is, in a receptacle. The developer which is intended to be treated in the above manner, however, usually comprises certain components which react with each other or which are not miscible with each other. Particularly, such components as developing agents or preservatives react with other components and are oxidized to decrease in their effective amount. On this account, the developer components are individually held in each single division of the receptacle which has been partitioned so as to provide a plurality of separate divisions therein with the view of obviating such difficulties as mentioned above. In the case of color developer, in particular, the receptacle used therefor comprises a large number of divisions into which the developers components are individually contained. The developer component to be held in a single division (hereinafter called "package") of the receptacle is advantageously in a state of liquid or aqueous solution, and accordingly when the developer components staying in such state are mixed together to prepare a developer solution, such time-consuming dissolution of the components as conventionally required can be spared.

Generally, in the above-mentioned dependent packages, there are contained such developing agents as phenidone, hydroquinone, metal, para-phenylenediamine salts, etc.; sucn preservatives as hydroxylamine sulfate, sulfites, etc.; metal chelating agents used as hard water-softening agents; alkali agents and buffers; and such organic solvents as benzyl alcohol, etc.

In light of the fact that the receptacle comprises a large number of independent packages containing such developer components as mentioned above, even though these components are all in a liquid state, it is clear that such abundance of the independent packages not only requires much time for preparing a developer solution by mixing together these packed developer components but also provides a serious hinderance to the performance of an autoreplenishment system (hereinafter called "AR replenishment").

By "AR replenishment" as referred to above is meant a procedure wherein every package at every receptacle is independently connected to a quantitative pump by which the package is replenished with a fresh component solution destined thereto in response to the measured surface areas of photographic materials treated and the period of time during which the development treatment has stopped. While the replenishment of dissolving agent consisting of water only is separately effected in the same manner as above. As a consequence of the performance of AR replenishment, the results obtained thereby are practically the same as those obtainable by the replenishment of a single replenishing solution which has previously been prepared by mixing all development components together, and thus the AR replenishment is a simple system by which the trouble of dissolving development components to obtain a desired single developer solution can greatly be saved. The abundance of independent packages as mentioned above, however, not only results in increment of number of pumps to be installed in an AR replenishment apparatus but also in unevenness of accuracy of concentrations of the components in the replenishing solution as well as in difficulty of maintaining uniform concentrations of the components in the developer solution which is in use. Owing to these circumstances, there have heretofore been adopted certain procedures to inhibit the aforesaid interactions among the developer components so far as is technically possible. As technical means reported to be capable of answering the above-mentioned purpose, there are proposed such processes as can be seen in Japanese Patent Publications Nos. 37975/1970 and 33378/1972, Japanese Patent Laid-Open-to-Public Publn. No. 16533/1975 and U.S. Pat. No. 352,494. As will be explained hereinafter, however, the fact was that complete inhibition of the interaction among the developer components was difficult to attain even by the adoption of the above-mentioned processes and for attaining stabilization of the developer solution in storage there was no alternative but to hold said solution in a receptacle which has been so designed that the developer components can be retained separately in numbers of independent packages. Of the components of photographic developer composition, for example, 1-phenyl-3-pyrazolidone (phenidone) which is a black-and-white developing agent is liable to hydrolysis in its aqueous solution and the hydrolysis is accelerated even when the pH of said aqueous solution is low. On this account, 4-hydroxyethyl-4-methyl-1-phenyl-3-pyrazolidone obtained by introducing a substituted group into the 4-position of phenidone is sometimes used instead for the reason that the 4-substituted phenidone is less liable to hydrolysis. In that case, however, no perfect inhibition of the hydrolysis can be attained and, therefore, 1-phenyl-3-pyrazolidone, when it is packed and held for storing purposes in a liquid state, is usually used after dissolving it in an organic such as ethylene glycol, diethylene glycol or the like. However, no effectiveness as desired can be expected in that case since 1-phenyl-3-pyrazolidone itself is always liable to oxidation, if the independent package containing 1-phenyl-3-pyrazolidone is intended to be store for a long period of time. As an alternative to the above procedure, there is considered another means of incorporating hydroquinone or sulfite as a preservative into 1-phenyl-3-pyrazolidone. This means, however, is not preferable for such reasons that when a total amount of hydroquinone or sulfite usually necessary for use in a developer solution is incorporated into 1-phenyl-3-pyrazolidone, deterioration in function of 1-phenyl-3-pyrazolidone markedly proceeds, while the incorporation into 1-phenyl-3-pyrazolidone of hydroquinone or sulfite in such a small amount as capable of functioning as a preservative unavoidably results in division into two independent packages of hydroquinone or sulfite, one package of which contains hydroquinone or sulfite as a preservative together with 1-phenyl-3-pyrazolidone, and the other contains hydroquinone or sulfite for its original purpose as intended.

In the case of color developer, on the one hand, since para-phenylenediamine color developing agent and hydroxylamine sulfate, when they are packed together in the same singly package, mutually undergo oxidation-reduction reaction to decompose, the single package cannot be stored for an extended period of time even at any level of pH from a viewpoint of stabilization, and these ingredients are usually packed in separate package independently. Furthermore, since sulfite and hydroxylamine sulfate mutually decompose likewise owing to oxidation-reduction reaction, they are packed individually in two separate packages. Since para-phenylenediamine color developing agent is usually an acid salt, its aqueous solution shows a strong acidity and is fairly stable under strongly acidic environment even when left alone. However, this aqueous solution is usually incorporated with a small amount of sulfite for preservative purposes when it is intended to be stored for a period of more than one year. It is reported however, that when a total amount of sulfite usually necessary for color developer solution and a usually necessary amount of para-phenylenediamine color developing agent are packed together in a single package, unexpectedly the developing agent undergoes deterioration to a great extent. Accordingly, the developing agent is packed together with a very small amount of sulfite in a single package, hydroxylamine is packed alone in a single package, the remaining large proportion of sulfite is packed together with large amounts of alkali agent or buffer in a single package, and an organic solvent such as benzyl alcohol or ethylene glycol is packed together with fluorescent whitening agent in another single package. Still further, hydrogen peroxide, such hydrogen peroxide-releasing compounds as percarbonates or perboric acid, or such oxidizing agents as cobalt hexamine cobalt complex salt and the like are commonly packed individually in independent packages. Under such circumstances, therefore, a great desideratum long felt by those skilled in the art is an advent of a liquid developer composition comprising the smallest possible number of independent packages containing individual developer components in such a manner that any interaction among said components can be inhibited.

Accordingly, an object of the present invention is to provide a developer composition comprising the smallest possible number of independent packages for storing and packing components of the developer composition, wherein the components held in the package do not react with each other and remain stable at ordinary temperature for several years.

The present inventors prosecuted extensive researches with the view of finding a process, and a composition obtainable thereby, for obviating such unstableness of developer compositions as evidenced by an unexpected and important fact that deterioration during storage of a solution of two or more developer components liable to react with each other cannot be inhibited perfectly even by the adoption of any conventional means hitherto known, and in most cases after a one to two-year storage at ordinary temperature, these developer components deteriorate to such an extent that they are practically useless.

As the result, the present inventors have found that in a photographic developer composition comprising a plurality of developer components, including an alkali agent, having been packed in two or more receptacles, the object of the present invention can be accomplished by covering at least one of said developer components except alkali agent with an alkali soluble polymer, holding the thus covered developer component in at least one receptacle which does not contain the alkali agent substantially and is selected from said receptacles.

In the developer composition of the present invention, particularly advantageously covered with an alkali soluble polymer are color and black-and-white developing agents such as 1-phenyl-3-pyrazolidone and derivatives thereof, hydroquinone and derivatives thereof, methol, para-phenylenediamine salts, etc.; preservatives such as sulfites, hydroxylamine salts, etc.; hydrogen peroxide and hydrogen peroxide-releasing compounds; and Co(III) complex salts such as hexaamine cobalt complex, etc.

Generally, the major proportion by weight or volume of a developer composition directed to color development is occupied by alkali agents and buffers, and by sulfites in addition thereto when the composition is directed to black-and-white development. It is not so advisable to cover with an alkali soluble polymer these major components in point of weight or volume since adverse influence on said major components of interaction with other components is small due to the presence of the major components in large amounts. For attaining the object of the present invention, therefore, components of a developer composition, which are used in minute amounts and which quickly undergo mutual reaction with other components or are liable to air oxidation, may be preferably covered with the alkali soluble polymer. Though particle size of developer component particles covered with an alkali soluble polymer is desirably as small as is possible for the purpose of attaining homogeneous dispersion of the particles in a liquid state in the developer package and good mixing efficiency of the powder developer particles, the particles may be in a state of so-called millicapsule, microcapsule or nanocapsule.

Alkali soluble polymer referred to in the present invention should be those which are soluble at pH of at least 8.0 and completely soluble at pH of 9.0–10.0.

Such polymers mentioned above are those which have pendant carboxyl group, sulfo-group and the like, for example, such vinyl polymers as copolymers of such monomers as methacrylic acid, acrylic acid, etc. with pendant carboxyl or sulfo-group and monomers including such acrylic acid esters as ethyl methacrylate, methyl methacrylate, etc., such styrene as styrene, α-methylstyrene, etc. and such vinyl ketones as vinylmethyl ketone, etc. In these vinyl polymers, the proportion of the monomer having pendant carboxyl or sulfo-group to other monomer is preferably 40:60–70:30 by weight. An alkali soluble polymer having a pendant—$PO_2H_2$ or—$PO_3H_2$ may also be used, and such example are as follows: an addition compound of aminoalkyl phosphonic acid and a copolymer of styrene-maleic anhydride, an addition compound of aminoalkyl phosphorus acid and a copolymer of styrene-maleic anhydride. As condensation type polymers, there may be mentioned condensation products of lysine with such polycarboxylated products as terephthaloyl fluoride, adipate fluoride, sebacate fluoride, etc. and carboxycontaining cellulose derivatives having carboxyl groups in the molecule.

In capsulating a developer composition with such alkali soluble polymer, namely, covering the developer components with said polymer where the component particles of about 10–20 in particle size, there is adopted the spray drying method which comprises atomizing a mixture of the developer component particles and the polymer solution through a two-port atomizer (a concentric double orifice), followed by removal of the solvent. In addition thereto, there are adopted general methods which are often practiced in the art for the purpose, such as coacervation, orifice, spray drying, in-liquid drying, in-situ polymerization, interfacial polymerization and the like methods. In the preparation of developer component particles to be formed into a state of nanocapsule, particle size of which is less than microcapsule, there may be adopted micell polymerization or electrical emulsion polymerization process. These methods or processes are fully described, for example, in Journal of Pharmaceutical Science, Vol. 162, 12, p. 1763–1766 (1976), FEBS letter, Vol. 184, 2, p. 323 (1977), Journal of Colloid Interface Science, Vol. 64, 2, p. 278 (1978), and Canadian Journal of Physiology and Pharmacology.

In the present invention, the receptacle wherein the developer component covered by alkali soluble polymer is held does not contain the alkali agent substantially is such that the receptacle contains the alkali agent in the amount less than one tenth of total amount of alkali agent.

In the developer compositions of the present invention, desirably covered with alkali soluble polymers are such developer components as bringing about mutual reaction with other components under alkaline circumstances thereby mutually decreasing in effective amounts thereof, or such developer components as decomposing themselves under alkaline circumstances thereby decreasing in concentration of their active ingredients. Thus, it is a preferable practice to preserve such components in separate packages apart from those in which alkali agents are packed and mix together, when the developer composition is actually used, these packages so that the polymer-covered developer components are eluted to mix with the alkali agents to prepare an effective developer composition as expected. Though the alkali agents may be covered with alkali soluble polymers in the above case, when the developer components are mixed together to prepare a desired developer composition, at least part of the alkali agents, i.e. the alkali agent in an amount necessary for dissolving the alkali soluble polymer, is not covered with the polymer and is desirably packed in a package which does not contain the alkali soluble polymers.

Such components other than the developer components mentioned above but usually used in the developer composition may also be covered with the polymer.

In accordance with the present invention, hydroxylamine sulfate can be dispersed to coexist with a color developing agent in the same single package by covering said sulfate with an alkali soluble polymer. By virtue of covering a color developing agent with an alkali soluble polymer, the agent can be allowed to coexist with a hydroxylamine sulfate solution in the same single package, and in this case the covered agent can be allowed to coexist with an acid sulfite solution, as well. By covering a sulfite with an alkali soluble polymer, the sulfite thus covered can be allowed to coexist with a color developing agent solution in the same single package, and the covered sulfite can also be allowed to coexist with a hydroxylamine sulfate solution in the same single package. Furthermore, by covering both sulfite and hydroxylamine sulfate with an alkali soluble polymer, an acid solution of a color developing agent and the above-mentioned covered two components can also be allowed to coexist together in the same single package.

Any components other than the above-mentioned three components, excepting alkali agents, which do not bring about mutual reaction with each other can also be allowed to coexist in any of the above-mentioned cases with the aforesaid polymer-covered components in any single package.

Oxidizing agents and peroxides used in the intensification process adapted to color development are known to be highly unstable, high in reactivity with coexisting components, and deteriorate quickly. Of the agents for treatment used in the intensification process, hydrogen peroxide or percarbonates and perborates which are hydrogen peroxide-releasing compounds are advantageously covered with an alkali soluble polymer and then packed in independent packages separate from those of alkali agents in accordance with the present invention.

In the case of monobath developer-fixer solutions, moreover, it is of advantage to cover sulfites, or thiosulfates, thioglycol thiourea as fixers with an alkali soluble polymer.

In the case of black-and-white development, sulfites covered with an alkali soluble polymer can be allowed to coexist in the same independent package with hydroquinone and/or hydroquinone derivative solutions in the same independent package, with the result that the long-term storage stability thereof can be greatly improved.

Furthermore, phenidone and/or phenidone derivatives which have been covered with an alkali soluble polymer can be stably stored in acid solutions for a long period of time.

In the procedure according to the present invention, developer components which have been covered with an alkali soluble polymer are desirably dispersed in acid solutions. Even when such compenents are powder compositions, however, these all components except alkali agents can stably be retained in a single independent package.

The alkali soluble polymers usable in the present invention are preferably those which quickly dissolve at pH of at least 8 without leaving any sludge after dissolution thereof.

Selection of the polymer to be used in the present invention can readily be made by those skilled in the art on the basis of experiments, though the kind of alkali soluble polymer to be actually used varies according to the component to be covered therewith and to the thickness of the polymer coating to be provided.

In this connection, though the thickness of the polymer coating is preferably as thin as possible, but an excessive thinness of the polymer coating results in bringing about mutual reaction among the polymer-covered components. The thickness of polymer coating to be formed on each component can be determined by experiments.

In the present invention, the developer composition components which can be covered with the alkali soluble polymer include all such as may be used in black-and-white developer compositions.

Components which are typical of those of the black-and-white developer include such developing agents as 1-phenyl-4-methyl-4-hydroxymethyl-3-pyrazolone, 1-phenyl-4-methyl-4-hydroxeyethyl-3-pyrazolone, hydroquinone, etc., such preservatives as sulfites, sulfurous acid aldehyde addition products, carbonyl addition products, etc., such inorganic or organic retarders as mercapto compounds, 2-methylbenzimidazole, methylbenzimidazole, bromides, iodides, etc., and chelating agents such as aminopolycarboxylic acids, organic phosphates, organic sulfonates, organic phosphonocarboxylic acids, etc.

As aromatic primary amine color developing agents which are typical of components of general color developer composition, there may mentioned, for example, N-ethyl-methoxyethyl-3-methyl-p-phenylenediamine tosylate, 3-methyl-4-amino-N-ethyl 2-(2-methoxyethoxy)aniline tosylate, N,N-diethyl-p-phenylenediamine sulfate, 4-amino-N-ethyl-N-β-hydroxyethylaniline sulfate, 3-methyl-4-amino-N-ethylβ-methanesulfonamidoethylaniline sesquisulfate monohydrate, 3-methyl-4-amino-N-ethyl-N-β-hydroxyethylaniline sulfate, 2-methoxy-4-phenylsulfonamidoan 2,6-dibromo-4-aminophenol, etc. With respect to other useful typical color developing agents, reference should be made to Muse and James, "The Theory of the Photographic Process", Third Edition, 1966, The MacMillan Co., N.Y. p. 278–311, U.S. Pat. No. 3,813,244 and 3,791,827. The color developing agents disclosed therein can also be used in the present invention.

In embodiments of the present invention, aromatic primary amine color developing agents which give particularly favorable results are 4-amino-N,N-diethylaniline hydrochloride, 4-amino3 -methyl-N-ethyl-N-(β-methanesulfonamidoethyl)aniline sulfate hydrate, 4-amino-3-methyl-N-ethyl-N-β-hydroxyethylaniline sulfate, 4-amino-3-dimethylamino-N,N-diethylaniline sulfate hydrate, 4-amino-3-methoxy-N-ethyl-N-β-hydroxyethylaniline hydrochloride, 4-amino-3-(β-methanesulfonamidoethyl)-N,N-diethylaniline dihydrochloride and 4-amino-N-ethyl-N-(2-methoxyethyl)-m-toluidine-2p-toluenesulfonate.

Furthermore, precursors of color developing agents can also be covered with an alkali soluble polymer, and usable precursors in the present invention are those disclosed in U.S. Pat. Nos. 2,507,114, 2,659,234 and 3,342,599, Shiff base type precursors of color developing agents disclosed in Research Disclosures, Vol. 151, No. 15159, Nov. 1979, and precursors disclosed in Research Disclosures, Vol. 129, No. 129240, Oct. 1976, Vol. 121, No. 12146, June 1974 and Vol. 139, No. 13924, Nov. 1975.

Usable as alkali agents in the present invention are, for example, such strong alkali agents as sodium hydroxide, potassium hydroxide, etc., and carbonates, phosphates, borates, or the like of alkali metals.

Furthermore, besides such acid agents and pH regulators as sulfuric acid, hydrochloric acid, nitric acid, acetic acid and boric acid, such developer components as may be coated with the polymer include such foggants as tin chlorides and borohydrides, alkali soluble couplers and colorless couplers, and organic solvents such as acetone, benzyl alcohol, diethylene glycol and ethylene glycol.

Exemplarily mentioned as the preservatives, are hydroxylamine sulfate, sodium sulfite, potassium sulfite, potassium or sodium bisulfite, bisulfite adducts of hydrazine aldehyde, such dihydroxy acetone, glycol aldehyde and glyceraldehyde as disclosed in U.S. Pat. No. 3,615,503, such hydroxamic acid or its derivatives as disclosed in Japanese Patent Laid-Open-to-Public Publn. No. 27638/1977, and triethanolamine, etc.

As retarders and antifoggants, there may be mentioned such nitrogen-containing heterocycles as benzotriazole, 6-nitrobenzimidazole, 5-nitroisoindazole, 5-methylbenzotriazole, 5-nitrobenzotriazole and 5-chlorobenzotriazole, such mercapto-substituted heterocycles as 1-phenyl-5-mercaptotetrazole and 2-mercaptobenzothiazole, and such mercapto-substituted aromatic compounds as thiosalicyclic acid. As chelating agents or water softeners, there may be mentioned sodium hexametaphosphate, sodium tetrapolyphosphate, sodium tripolyphosphate or polyphosphate compounds represented by potassium or the like salts of the above-mentioned polyphosphoric acids, such aminopolycarboxylic acids as ethylenediamine tetraacetic acid, benzylamine diacetic acid, benzylethylenediamine triacetic acid, cyclohexanediamine tetraacetic acid transform, dihydroxyethyl glycine, diethylenetriamine pentaacetic acid, diaminopropanol tetraacetic acid, ethylenediaminediorthohydroxyphenyl acetic acid, ethylenediamine dipropionic acid, hydroxyethylethylenediamine triacetic acid, glycol ether diamine tetraacetic acid, hydroxyethylimino diacetic acid, iminodiacetic acid, diaminopropane tetraacetic acid, nitrodiaceticpropionic acid, nitrilotriacetic acid, nitrilotripropionic acid, triethylenetetraminehexaacetic acid, etc., such oxycarboxylic acids as citric acid, gluconic acid, etc., and 1-hydroxyethylidene-1,1-disulfonic acid, 2-phosphonobutane-1,2,4-tricarboxylic acid, aminotri (methylenesulfonic acid), and the like.

Usable development accelerators include various pyridinium compounds, cationic compounds, such cation dyes as phenosafranine and such neutral salts as thallium nitrate and potassium nitrate disclosed in U.S. Pat. Nos. 2,648,604 and 3,671,247, and Japanese Patent Publication No. 9503/1969, polyethylene glycol or derivatives thereof and nonionic compounds such as polythio ethers disclosed in Japanese Patent Publication No. 9504/1969, U.S. Pat. Nos. 2,533,990, 2,531,832, 2,950,970 and 2,577,127, such organic solvents or organic amines as ethanolamine, diethanolamine, etc., accelerators disclosed in F. A. Mason, "Photographic Processing Chemistry", (Focal Press—London on 1966), p. 40–43, such benzyl alcohol and phenylethyl alcohol as disclosed in U.S. Pat. No. 2,515,147, and pyridine, ammonia, hydrazine, amines, etc. as disclosed in J. Soc. Phtogr. Sci, Tech. Lpn. 14 (1952), p. 74.

Furthermore, as usable oxidizing agents, there may be mentioned hydrogen peroxide, perborates, percarbonates, hexaamine cobalt, rutheniumamine complex, etc.

EXAMPLE 1

In-liquid drying

Forty (40) g of particulate hydroxylamine ½ sulfate (10–20μ) is added to a solution of 20 g of a methacrylic acidmethyl methacrylate copolymer (methacrylic acid:-methyl methacrylate =50:50 by weight), and the mixture is thoroughly stirred to obtain a homogeneous dispersion. Subsequently, this dispersion is gradually added with stirring to a solution of 1 g of sorbitan monolate in 600 ml of methanol, thereby forming dispersion particles comprising the aforesaid particulate hydroxylamine particle as core covered with the aforesaid copolymer solution. The dispersion particles are then gradually heated at 65° C. with stirring to distill off the methanol. The temperature is elevated to 75° C. 3–4 hours thereafter, and the distillation is continued until the methanol is completely removed. The distillate is then filtered, washed with n-hexane and dried. The thus obtained particles were confirmed to be those which have been microcapsulated with the methacrylic acid-methyl methacrylate copolymer by powder reflection, I.R. etc., said particles comprisihg a core of the hydroxylymine ½ of 12–21μ in particle size. Furthermore, as a result of observation of the surface state by a scanning type electron microscope, it was confirmed that the particles hold their uniform and smooth surface state.

The microcapsules thus obtained were added, 5 g in each case, to 100 ml of a buffer of pH 2.0, 4.0, 8.0, 10.0 and 12.0, respectively, stirred with a magnetic stirrer and then allowed to stand for 24 hours. After having been filtered, the filtrate was determined for the hydroxylamine contained therein, whereupon on the basis of the theoretical value it was found to be 0.20 at pH 2.0, 0.26 at pH 4.0, 11.3% at pH 8.0, 96% at pH 10.0 and 96% at pH 12.0. No filtration residue was observed at all in the buffers of pH 10.0 and pH 12.0, respectively, and it was ascertained that the polymer had completely dissolved therein.

EXAMPLE 2

The same microcapsules as used in Example 1 were added, 20 g in each case, to a buffer of pH 2.0, 4.0, 8.0, 10.0 and 12.0 respectively, in the same manner as in Example 1, and thereto was added 5 g of N-ethyl-N-β-methansulfonamidoethyl-3-methyl-4-aminoaniline sulfate as a color developing agent, and the mixture was put in a polyethylene bottle (capacity of 120 ml) which was then sealed and allowed to stand at 38° C. for 40 days.

For comparative purposes, a mixture of 12 g of hydroxylamine sulfate, 0.5 g of sodium sulfite and 5 g of N-ethyl-Nβ-methanesulfonamidoethyl- 3-methyl-4-aminoaniline sulfate was added to a buffer of pH 2.0 to prepare a sample which was then stored in the same manner as above. To the samples comprising the microcapsulated hydroxylamine sulfate after storage was added 20 ml of 30% potassium hydroxide to completely dissolve the polymer and, thereafter, the hydroxylamine sulfate and the color developing agent were assayed to obtain residual amounts thereof after the storage.

As the result, even in the samples comprising the polymercovered hydroxylamine sulfate, when the solutions containing the same were stored at pH of less than 8.0, both the hydroxylamine sulfate and color developing agent reduced in residual amounts to less than 50%. On the other hand, in the comparative sample where the uncovered hydroxylamine sulfate, color developing agent and sulfite were allowed to coexist, the hydroxylamine sulfate was reduced by 40% in spite of low pH of the solution containing the same, and the color developing agent was reduced by 35%.

While in each sample comprising the hydroxylamine sulfate covered with the alkali soluble polymer according to the present invention, color developing agent and a small amount of sulfite, which was stored in the buffer of pH of less than 4.0, neither dissolution of the alkali soluble polymer nor reduction of the components was observed.

That is, it was understood that in the present invention, the components covered with the alkali soluble polymer, no deterioration of the components due to oxidation or decomposition is practically observed if the alkali soluble polymer does not dissolve.

EXAMPLE 3

(In situ polymerization)

Forty (40) g of particulate hydroxylamine ½ sulfate (10–20μ) is added to a solution of 10 g methacrylic acid, 10 g of methyl methacrylate and 0.6 g of azobisisobutyronitrile in 500 ml of carbon tetrachloride, thoroughly stirred and uniformly dispersed. Subsequently, the dispersion is heated at 60° C. and allowed to undergo reaction with stirring for 10 hours. After the completion of the reaction, the reaction liquid is filtered, washed with carbon tetrachloride and then dried. The particles thus obtained were confirmed, according to powder reflection and I.R., that they are those which have been covered with the methacrylic acid-methyl methacrylate copolymer, comprising as a core thereof the hydroxylamine ½ sulfate. Furthermore, as a result of observation of the surface state by a scanning type electron microscope, it was confirmed that the particles had a uniform and smooth surface state.

By conducting generally the same test methods as in Examples 1 and 2, it was confirmed that when the capsulated particles are stored in an acid environment, no reduction of the hydroxylamine sulfate component takes place at all even when the particles are allowed to coexist with color developing agents or other components except alkali agents.

EXAMPLE 4

(Micell polymerization)

To a solution of 12.0 g of sulfosuccinic acid-bis-2-ethylhexyl ester sodium salt and 6.0 g of polyoxyethylene-4-lauryl ether in 80 ml of n-hexane is added gradually with thorough stirring a solution of 10 g of N,N-diethyl-3-methyltoluidine hydrochloride in 35 ml of distilled water. To the resultant mixture are then added 0.1 g of N,N'-methylenebisacrylamide and 10 g of methacrylic acid. In the thus obtained solution is dissolved with stirring in a cylindrical double-wall reactor 1 mg of sodium riboflavin-5'-phosphate and 1 mg of potassium persulfate. While blowing nitrogen into the solution being continuously stirred, the solution is irradiated at a temperature of 35° C.±5° C. at a distance of 15 cm with an incandescent bulb (300 W) until no monomers remain in the solution. Subsequently, the n-hexane is distilled off under reduced pressure, ultrafiltration is carried out with the addition of water to remove the surfactant, and the resulting capsules are separated by means of a centrifugal separator. The thus obtained capsulated particles had a particle size of 100–300 nm.

EXAMPLE 5

Following generally the same procedure as in Example 4, but substituting polyethylene glycol diacrylate for the N,N'-methylenebis acrylamide, there were obtained alkali soluble polymer-covered particles similar to those of Example 4.

EXAMPLE 6

In the procedure described in Example 4, N-ethyl-N-β-methanesulfonamidoethyl-3-methyltoluidine was used as a core in place of the N,N-diethyl-3-methyltoluidine hydrochloride to obtain alkali soluble polymer-covered particles similar to those of Example 4.

EXAMPLE 7

In the procedure described in Example 4, each of the color developing agent precursors represented by the following formulas was used a core in place of the N,N-diethyl-3-methyltoluidine hydrochloride to obtain alkali soluble polymer-covered particles similar to those of Example 4.

Color developing agent precursor:

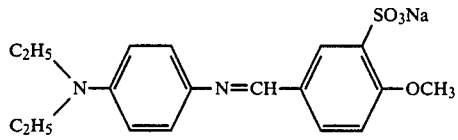

(1)

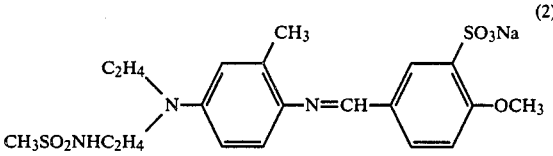

(2)

EXAMPLE 8

Following generally the same procedure as in Example 1, but using, as a core, sodium perborate as a hydrogen peroxide-releasing compound, alkali soluble polymer-covered particles similar to those of Example 1 were obtained.

EXAMPLE 9

Following generally the same procedure as in Example 1, while using, as a core, sodium percarbonate capable of releasing hydrogen peroxide, alkali soluble polymer-covered particles similar to those of Example 1 were obtained.

EXAMPLE 10

Following generally the same procedure as in Example 1, while using, as a core, hexaaminecobalt chloride, alkali soluble polymer-covered particles similar to those of Example 1 were obtained.

EXAMPLE 11

Microcapsules obtained in Examples 8–10 were individually stored in an acid solution of pH 2.0 for 3 months. Thereafter, the capsules were mixed, immediately before use, with an alkali agent to determine the oxidizing agent which remained in the capsules. The determination of hydrogen peroxide and of cobalt hexamine chloride was conducted according to iodine method and absorptiometry, respectively.

Each capsule as tested showed a satisfactory residual ratio in comparison with each control microcapsule which had not been stored in the same manner as above.

What is claimed is:

1. A photographic developer comprising a plurality of developer components, including an alkali agent, said plurality of developer components being packed in two or more separate receptacles, wherein at least one of said developer components other than the alkali agent is encapsulated in an alkali soluble polymer and is held in at least one of said receptacles which does not substantially contain said alkali agent.

2. A photographic developer composition according to claim 1, wherein the developer components except alkali agent is one selected from the group consisting of a color developing agent, a sulfite, a hydroxyl amine salt, a hydrogen peroxide, a hydrogen peroxide-releasing compound and a Co (III) complex salt.

3. A photographic developer according to claim 1, wherein the one receptacle which does not contain said alkali agent substantially is such that the receptacle contains the alkali agent in the amount less than one tenth of total amount of alkali agent comprised in said photographic developer composition.

4. A photographic developer composition according to claim 1, wherein the alkali soluble polymer is a polymer having a pendant carboxyl group or sulfo group.

5. A photographic developer comprising a plurality of developer components, including an alkali agent, said plurality of developer components being packed in two separate receptacles, wherein at least one of said developer components other than the alkali agent is encapsulated in an alkali soluble polymer and is held in one of said receptacles which does not substantially contain said alkali agent.

6. A photographic developer comprising a plurality of developer components, including an alkali agent, said plurality of developer components being packed in two separate receptacles, wherein at least one of said developer components other than the alkali agent is encapsulated in an alkali soluble polymer and held in a receptable with at least one component other than the alkali agent.

7. The developer of claim 6, wherein the color developing agent is encapsulated and held in a receptacle containing a hydroxylamine salt.

* * * * *